US006664697B2

(12) United States Patent
Bowman

(10) Patent No.: US 6,664,697 B2
(45) Date of Patent: Dec. 16, 2003

(54) ELECTRICAL SLIP RING APPARATUS HAVING MULTIPLE SPACED APART SUPPORT STRUCTURES

(75) Inventor: Anthony L. Bowman, Ripplemead, VA (US)

(73) Assignee: Northrop Grumman Corporation, Los Angeles, CA (US)

( * ) Notice: Subject to any disclaimer, the term of this patent is extended or adjusted under 35 U.S.C. 154(b) by 111 days.

(21) Appl. No.: 10/013,535

(22) Filed: Dec. 13, 2001

(65) Prior Publication Data

US 2003/0111928 A1 Jun. 19, 2003

(51) Int. Cl.[7] ..... H01R 39/08

(52) U.S. Cl. ..... 310/232; 310/235; 310/238; 29/597

(58) Field of Search ..... 310/232, 235, 310/238, 71, 143–147; 29/597, 596, 598; 439/660, 20, 21

(56) References Cited

U.S. PATENT DOCUMENTS

| | | | | |
|---|---|---|---|---|
| 5,054,189 A | | 10/1991 | Bowman et al. | 29/597 |
| 5,734,218 A | * | 3/1998 | Crockett et al. | 310/232 |
| 6,222,279 B1 | * | 4/2001 | Mis et al. | 257/779 |
| 6,356,002 B1 | * | 3/2002 | Witherspoon et al. | 310/232 |

FOREIGN PATENT DOCUMENTS

| | | |
|---|---|---|
| DE | 917496 | 6/1954 |

* cited by examiner

*Primary Examiner*—Nestor Ramirez
(74) *Attorney, Agent, or Firm*—Lowe Hauptman Gilman & Berner, LLP

(57) ABSTRACT

The present invention is directed to an electrical slip ring assembly having a plurality of conductive rings held in place by multiple spaced apart comb-like structures advantageously eliminates the need for molding the conductive rings as part of the base or plating the conductive rings into completed bases. Further, the present invention eliminates the need to machine an annular base or perform expensive and time consuming operations to roll conductive strips into a machined base member.

24 Claims, 3 Drawing Sheets

ELECTRICAL SLIP RING APPARATUS HAVING MULTIPLE SPACED APART SUPPORT STRUCTURES

FIELD OF THE INVENTION

The present invention relates generally to a method of manufacturing an electrical slip ring assembly and to an electrical slip ring apparatus. More particularly, the present invention relates to a method and apparatus of constructing an electrical slip ring assembly using a plurality of spaced apart comb-like structures for supporting multiple electrically conductive slip rings.

BACKGROUND OF THE INVENTION

Electrical slip rings are well known devices for communicating electrical signals from one structural member to another where one of the structural members is rotatable with respect to the other. Such a slip ring assembly, for example, may comprise a relatively stationary annular base member which has a plurality of conductive rings extending around an outer circumferential face thereof. Each of the rings extends around a substantial portion of the circumference of the slip ring base. A series of electrically conductive brushes are arranged on a relatively rotatable structural member to rotate about the slip ring base, and each of the brushes is arranged to contact a surface of one of the conductive rings thereby forming a series of electrical connections between the two structural members.

Heretofore, the methods of manufacturing slip ring bases of the type discussed herein above have included either molding the conductive rings as a part of the base while the base itself is being molded or plating the conductive rings into previously completed slip ring bases having grooves formed therein for the conductive rings. Both techniques require expensive tooling and machining operations which are now proving to be prohibitively expensive.

In connection with the molding process mentioned above, it is necessary that conductive rings be positioned within a mold so that, for example, epoxy can be cast around the rings to produce the slip ring base. Expensive tooling is required to support and maintain the rings at the proper position as the molding process is carried out. These rings are then plated, once the molding process has been completed, and this requires additional tooling. Using this technique, if the casted epoxy happens to have voids or otherwise does not properly bond to the conductive ring materials, it is not unusual to find that plating solutions can be trapped in the epoxy or around the rings. After a short period of use of the slip ring, these solutions can migrate to the ring surfaces and cause excessive wear and intermittent electrical contact problems.

Using those techniques where plating occurs after molding, it is not unusual to find that the plating does not adhere properly to the base member. In this event, the conductive rings must be removed, remachined and replated. It can readily be seen that these will be expensive and time consuming operations. In many cases it is not possible to repair the damage and at least the entire slip ring based must be discarded. This loss is a significant one.

A prior art method for manufacturing an electrical slip ring is described in U.S. Pat. No. 5,054,189 to Bowman et al. (hereinafter "the '189 patent", entitled "Method of Manufacturing An Electrical Slip Ring Assembly". The difficulty with the method described in the '189 patent is that there is expensive tooling and machining required to fabricate the electrical slip ring assembly. More specifically, the annular base member 10 in the '189 patent, grooves 12 and 16 are machined and conductive strips 12 are placed therein. Further, rolling the conductive rings 12 into the grooves 12 and 16 is time consuming and expensive. Accordingly, a need exists in the art for a method and apparatus which overcomes the need for expensive tooling and machining and reduces manufacturing as compared to current electrical slip ring manufacturing methods.

SUMMARY OF THE INVENTION

It is, therefore, an object of the present invention to provide an electrical slip ring assembly which does not require expensive tooling and machining to fabricate the assembly and reduces manufacturing costs.

It is another object of the present invention to provide an electrical slip ring assembly which eliminates the need for an annular base member.

Another object of the present invention is to provide a plurality of comb-like structures which support a plurality of electrically conductive slip rings.

The present invention is directed to an electrical slip ring assembly having a plurality of conductive rings held in place by multiple spaced apart comb-like structures advantageously eliminates the need for molding the conductive rings as part of the base or plating the conductive rings into completed bases. Further, the present invention eliminates the need to machine an annular base or perform expensive and time consuming operations to roll conductive strips into a machined base member.

These and other objects of the present invention are achieved by an electrical slip ring assembly. The electrical slip ring assembly includes a first plurality of annular conductive rings spaced from each other and a second plurality of circumferentially spaced electrically non-conductive support structures. The non-conductive support structures each have inwardly extending slots. The first plurality of conductive rings are each mounted in the inwardly extending slots in one of each of the second plurality of support structures such that each of conductive rings is spaced from adjacent ones of the conductive rings.

The foregoing and other objects of the present invention are achieved by an electrical slip ring assembly. The electrical slip ring assembly includes a first plurality of annular conductive rings spaced from each other and a second plurality of circumferentially spaced electrically non-conductive support structures. The non-conductive support structures each have inwardly extending slots. The first plurality of conductive rings are each mounted in the inwardly extending slots in one of each of the second plurality of support structures such that each of conductive rings is spaced from adjacent ones of the conductive rings. The conductive rings are vertically spaced from each other when mounted to the second plurality of support structures.

The foregoing and other objects of the present invention are achieved by an electrical slip ring assembly. The electrical slip ring assembly includes a first plurality of annular conductive rings spaced from each other and a second plurality of circumferentially spaced electrically non-conductive support structures. The non-conductive support structures each have inwardly extending slots. The first plurality of conductive rings are each mounted in the inwardly extending slots in one of each of the second plurality of support structures such that each of conductive rings is spaced from adjacent ones of the conductive rings. The conductive rings are horizontally spaced from each other when mounted to the second plurality of support structures.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description thereof are to be regarded as illustrative in nature, and not as restrictive.

BRIEF DESCRIPTION OF THE DRAWINGS

The present invention is illustrated by way of example, and not by limitation, in the figures of the accompanying drawings, wherein elements having the same reference numeral designations represent like elements throughout and wherein.

BEST MODE FOR CARRYING OUT THE INVENTION

Figure 1:
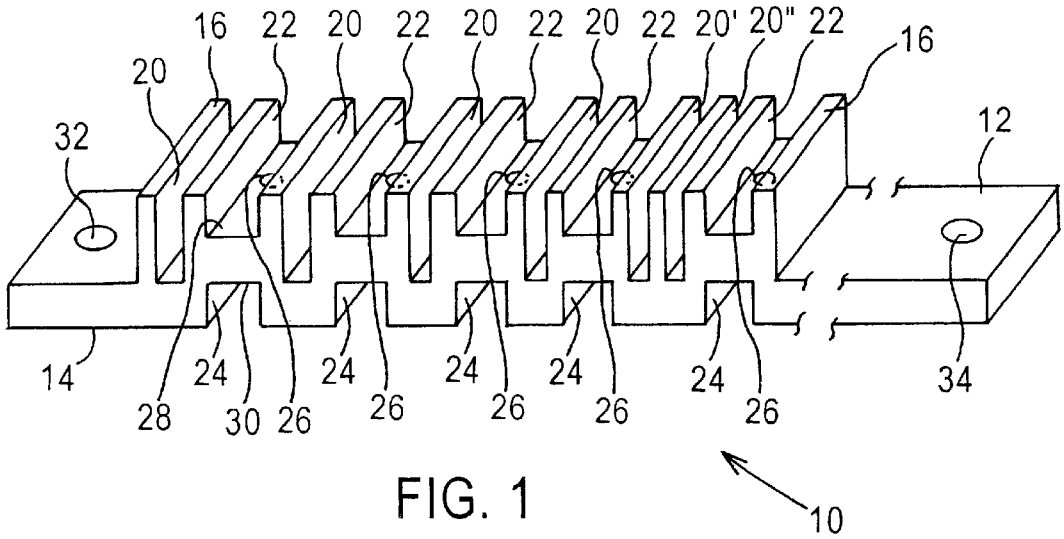
FIG. 1 is a perspective view of a comb-like support structure according to the present invention.

Referring first to FIG. 1, a perspective view of a comb-like structure 10 is illustrated. As described below, the comb-like structure advantageously eliminates the need for molding the conductive rings as part of the base or plating the conductive rings into completed bases. Further, the present invention eliminates the need to machine an annular base or perform expensive and time consuming operations to roll conductive strips into a machined base member. The comb-like structure 10 has an upper surface 12 and a lower surface 14. The electrically non-conductive comb-like structure 10 can be machined or molded from a suitable material. The comb includes a series of relatively narrow grooves 20 extending from a top surface 16. Although the grooves 20 appear to terminate at approximately same height as upper surface 12, the grooves 20 can extend downwardly below upper surface 12 as depicted in FIG. 1. A series of relatively wider grooves 22 are located between grooves 20. As depicted in FIG. 1, there are two adjacent relatively narrow grooves 20' and 20", the purpose of which will be explained in detail below.

Extending inwardly from the lower surface 14 are a plurality of relatively wider grooves 24 which are aligned with grooves 22. A through hole 26 extends from bottom surface 28 of grooves 22 through to each bottom surface 30 of grooves 24.

Figure 2:
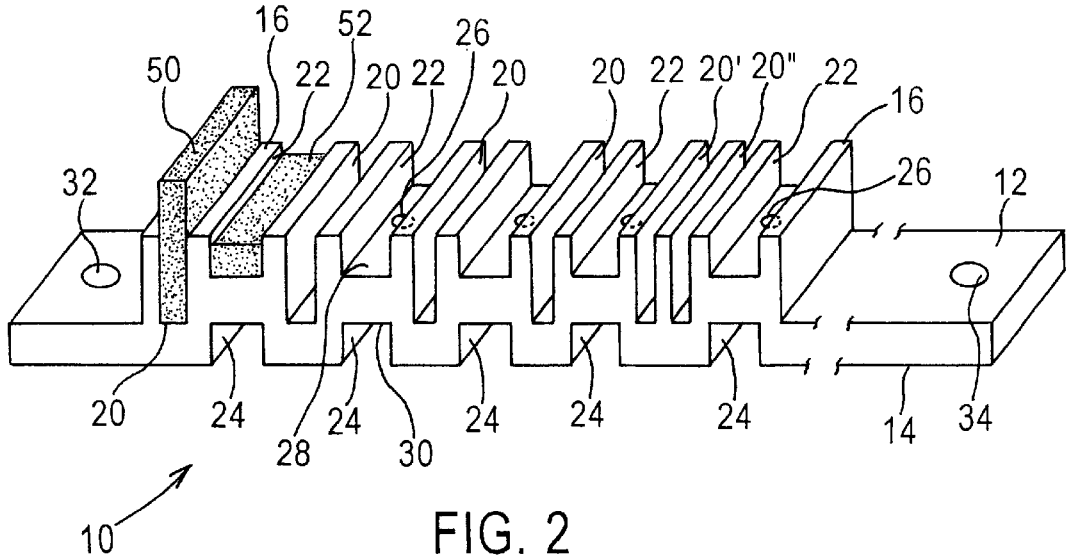
FIG. 2 is a perspective view of the comb-like support structure including a barrier and an electrically conductive ring installed in a slot of the comb-like structure.

Turning now to FIG. 2, the comb-like structure 10 is shown with a barrier 50 and an electrically conductive slip ring 52 installed in slots 20, 22, respectively. For simplicity, only one barrier 50 and conductive ring 52 are illustrated although each slot 20, 22 would include a corresponding barrier 50 or conductive ring 52. Depending on the voltage, there may not be a requirement for barriers or more than one barrier may be necessary. UL has standards for voltage creapage paths. The low power or signal circuits may have no barriers because they may have only millivolts of potential. The high voltage circuits, which could be as high as 500 volts or more, would need multiple barriers to stop arcing from one circuit to another.

Figure 3:
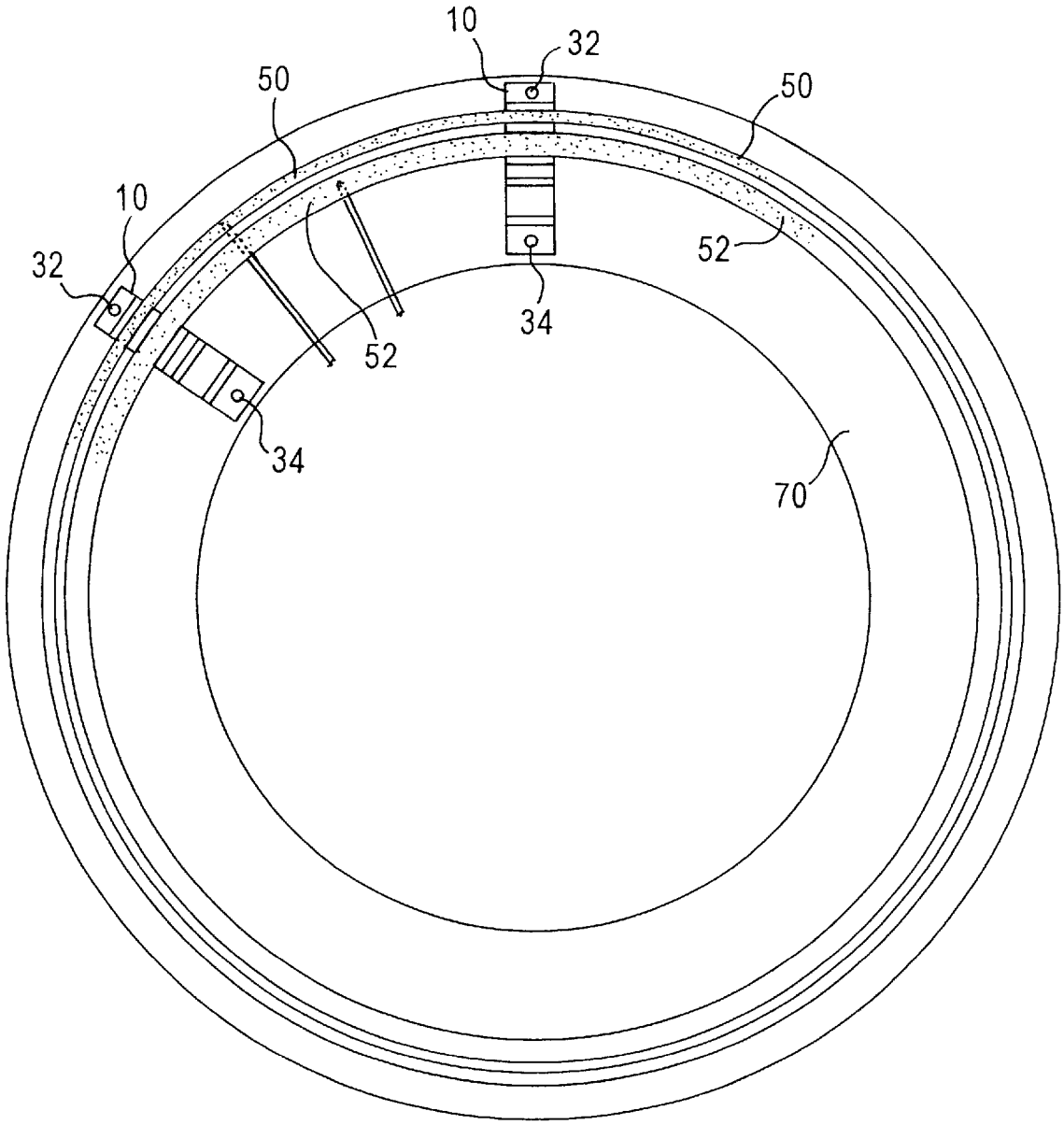
FIG. 3 is a top plan view of a pancake type slip ring according to the present invention.

The barrier 50 and the conductive ring 52 are engaged with the comb 10, although it should be understood, particularly with reference to FIGS. 3 and 4, that the rings 50, 52 are circular, annular rings and can be machined or formed in one or several sections to be made into a full 360° annular ring. The cross-sectional shapes of rings 50, 52 are selected to substantially conform to the shapes of the grooves 20, 22 to be mounted therein.

Figure 2A:
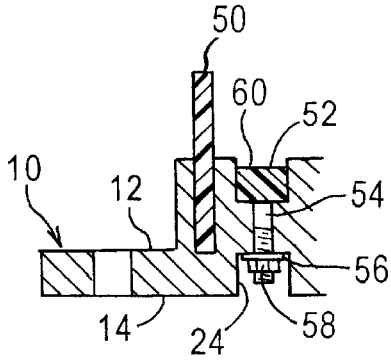
FIG. 2A is a cross-sectional view of a portion of the comb-like structure including the barrier and electrically conductive ring mounted to the comb-like support structure.

As depicted in FIG. 2A, the barrier 50 is mounted in the slot 20 by means such as press-fit, epoxy or the like. The ring 52 has a plurality of studs 54 which are welded or otherwise affixed to the ring 52. The stud 54 extends through a corresponding hole 28 in the comb-like structure 10. A washer and nut 56, 58, respectively, are positioned in each groove 24 and secure the respective section of ring 52 to the comb-like structure 10. As depicted in FIGS. 2 and 2A, the ring 52 is shallower than the corresponding slot 20 such that a top surface 60 of the ring 52 is positioned below the top surface 16 of the comb-like structure 10. By contrast, the barrier 50 extends upwardly from the top surface 16. In this manner, brushes (not shown) are kept electrically isolated from adjacent brushes and rings during the rotatable structural member (not shown).

Figure 4A:
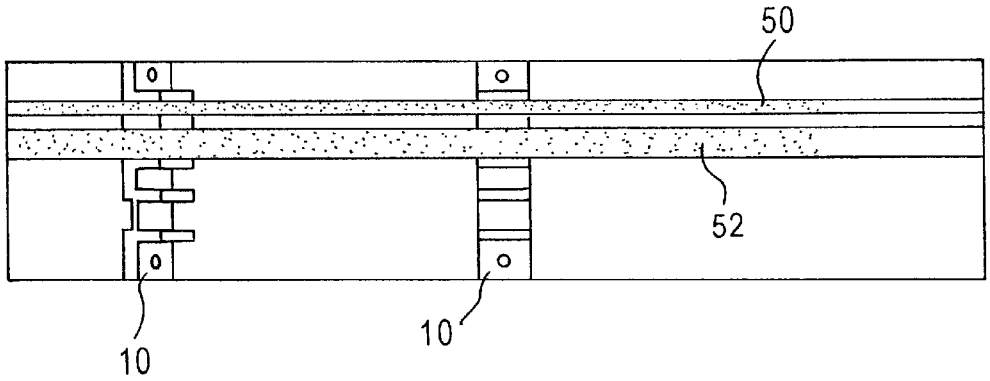
FIG. 4A is a side elevational view of a second embodiment according to the present invention in which each of the slip rings have the same diameter.
Figure 4B:
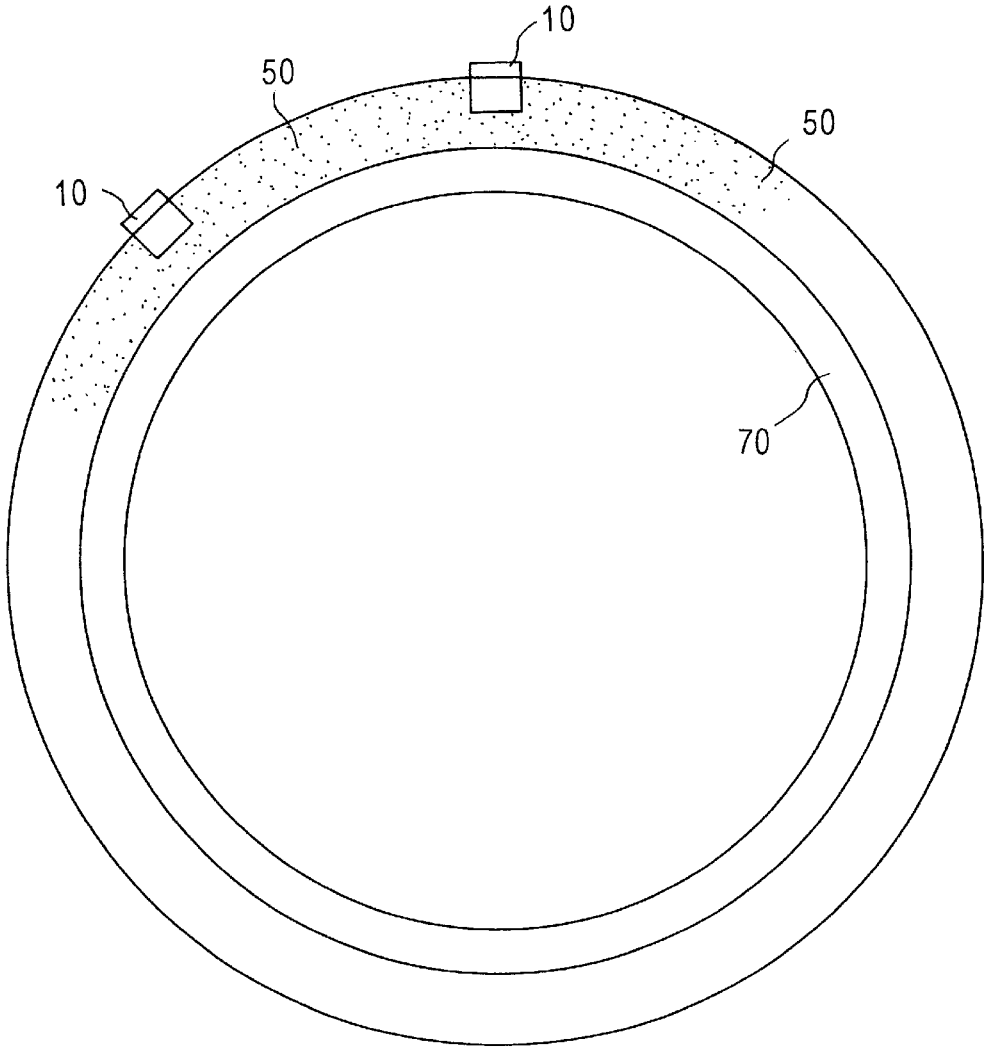
FIG. 4B is a top plan view of the embodiment shown in FIG. 4A.

A pancake type embodiment is depicted in FIG. 3 whereas an annular slip ring assembly is depicted in FIGS. 4A and 4B. In FIG. 3, a plurality of comb-like structure 10 are fastened to a base or bracket 70 through holes 32 and 34 in comb-like structure 10, using any type of known fastener. The comb-like structures 10 are circumferentially spaced from each other. The number of combs around the circumference is controlled by the mechanical stiffness of the conductive rings 52. A sufficient number of comb-like structures 10 must be installed on the rings 52 to maintain electrical contact as the brush moves over the non-supported area between comb-like structures 10. As depicted in FIG. 3, the rings 52 and barriers 50 are mounted to the comb-like structure 10. Electrical connections are made to each of the rings and the electrical connections exit the comb-like structures 10 to the inner diameter of the slip ring. The electrical barriers 50 between the conductive rings 52 can be epoxied or mechanically locked in place. The barriers are manufactured from a suitable, flexible, non-conductive material that can be easily installed in the slots 20 in the comb-like structures 10. The comb-like structures 10, rings 50, 52 can be secured to an epoxy base, either on the face as depicted in FIG. 3 or around the circumference as depicted in FIG. 4. As depicted in FIG. 3, each of the rings 50, 52 has a different diameter.

As depicted in FIG. 4, the individual comb-like structures 10 are mounted to a base or to individual brackets to support the comb-like structures. As depicted in FIG. 4B each of the electrical rings 52 has the same diameter. In all other respects, the FIG. 4 embodiment is identical to the FIG. 3 embodiment.

It will be readily seen by one of ordinary skill in the art that the present invention fulfills all of the objects set forth above. After reading the foregoing specification, one of ordinary skill will be able to affect various changes, substitutions of equivalents and various other aspects of the invention as broadly disclosed herein. It is therefore intended that the protection granted hereon be limited only by the definition contained in the appended claims and equivalents thereof.

What is claimed is:

1. An electrical slip ring assembly, comprising:

a first plurality of annular conductive rings spaced from each other;

a second plurality of circumferentially spaced electrically non-conductive support structures, each having inwardly extending slots;

said first plurality of conductive rings each being mounted in said inwardly extending slots in one of each of said second plurality of support structures such that each of conductive rings is spaced from adjacent ones of said conductive rings.

2. The electrical slip ring assembly of claim 1, wherein said conductive rings are vertically spaced from each other when mounted to said second plurality of support structures.

3. The electrical slip ring assembly of claim 1, wherein said conductive rings are horizontally spaced from each other when mounted to said second plurality of support structures.

4. The electrical slip ring assembly of claim 1, further comprising barriers mounted in some of said inwardly extending slots.

5. The electrical slip ring assembly of claim 4, wherein said inwardly extending slots including ring slots and barrier slots, each ring slot has barrier slots adjacent thereto.

6. The electrical slip ring assembly of claim 4, wherein said barrier slots are deeper than said ring slots.

7. The electrical slip ring assembly of claim 1, wherein each of said first plurality of conductive rings has the same diameter.

8. The electrical slip ring assembly of claim 1, wherein each of said first plurality of conductive rings has different diameters.

9. The electrical slip ring assembly of claim 1, wherein a contact surface of each of said conductive rings are positioned within said inwardly extending slot.

10. The electrical slip ring assembly of claim 1, wherein the second plurality of non-conductive support structures has a comb-like structure.

11. The electrical slip ring assembly of claim 1, further comprising fasteners securing said first plurality of conductive rings to said second plurality of support structures.

12. An electrical slip ring assembly, comprising:

a first plurality of annular conductive rings spaced from each other;

a second plurality of circumferentially spaced electrically non-conductive support structures, each having inwardly extending slots;

said first plurality of conductive rings each mounted in said inwardly extending slots in one of each of said second plurality of support structures such that each of conductive rings is spaced from adjacent ones of said conductive rings, wherein said conductive rings are vertically spaced from each other when mounted to said second plurality of support structures.

13. The electrical slip ring assembly of claim 12, further comprising barriers mounted in some of said inwardly extending slots.

14. The electrical slip ring assembly of claim 13, wherein said inwardly extending slots including ring slots and barrier slots, each ring slot has barrier slots adjacent thereto.

15. The electrical slip ring assembly of claim 13, wherein said barrier slots are deeper than said ring slots.

16. The electrical slip ring assembly of claim 12, wherein each of said first plurality of conductive rings has the same diameter.

17. The electrical slip ring assembly of claim 12, wherein the second plurality of non-conductive support structures has a comb-like structure.

18. The electrical slip ring assembly of claim 12, further comprising fasteners securing said first plurality of conductive rings to said second plurality of support structures.

19. An electrical slip ring assembly, comprising:

a first plurality of annular conductive rings spaced from each other;

a second plurality of circumferentially spaced electrically non-conductive support structures, each having inwardly extending slots;

said first plurality of conductive rings each mounted in said inwardly extending slots in one of each of said second plurality of support structures such that each of conductive rings is spaced from adjacent ones of said conductive rings, wherein said conductive rings are horizontally spaced from each other when mounted to said second plurality of support structures.

20. The electrical slip ring assembly of claim 19, further comprising barriers mounted in some of said inwardly extending slots.

21. The electrical slip ring assembly of claim 20, wherein said inwardly extending slots including ring slots and barrier slots, each ring slot has barrier slots adjacent thereto.

22. The electrical slip ring assembly of claim 20, wherein said barrier slots are deeper than said ring slots.

23. The electrical slip ring assembly of claim 19, wherein each of said first plurality of conductive rings has different diameters.

24. The electrical slip ring assembly of claim 19, wherein the second plurality of non-conductive support structures has a comb-like structure.

* * * * *